US006079805A

United States Patent [19]

Kishi

[11] Patent Number: 6,079,805

[45] Date of Patent: Jun. 27, 2000

[54] RECORDING DEVICE CAPABLE OF SETTING DRIVE VOLTAGE OF PRINT HEAD BASED ON ANALOG SIGNALS

[75] Inventor: Motoshi Kishi, Nagoya, Japan

[73] Assignee: Brother Kogyo Kabushiki Kaisha, Nagoya, Japan

[21] Appl. No.: 08/873,370

[22] Filed: Jun. 12, 1997

[30] Foreign Application Priority Data

Jun. 12, 1996 [JP] Japan ..... 8-172885

[51] Int. Cl.[7] ..... B41J 29/38

[52] U.S. Cl. ..... 347/9

[58] Field of Search ..... 347/9, 14, 17, 347/19, 49; 346/140, 76

[56] References Cited

U.S. PATENT DOCUMENTS 4,396,923 8/1983 Noda ..... 347/14
4,709,245 11/1987 Piatt ..... 347/14
5,285,220 2/1994 Suzuki et al. ..... 346/140

*Primary Examiner*—John Barlow
*Assistant Examiner*—Charles W. Stewart, Jr.
*Attorney, Agent, or Firm*—Pollock, Vande Sande & Amernick

[57] ABSTRACT

A signal line is provided for outputting, from a chip on board to a CPU, a drive voltage setting signal to be used to set drive voltage applied by an IC driver to an ink jet print head. The signal line divided into a first through third signal lines at the chip on board side. A first resistance is connected to the second signal line. A second resistance is connected to the third signal line. A first switch point capable of being brought into a continuous condition by application of solder is provided along the first signal line. A second switch point, also capable of being brought into a continuous condition by application of solder, is provided along the second signal line. The first and second switch points are selectively brought into continuous condition depending on a desired drive voltage to be applied to the print head. With this configuration, only a single signal line is required to set three different drive voltages.

23 Claims, 10 Drawing Sheets

FIG. 1 (A)

| RANK | VOLTAGE(V) REQUIRED AT 25℃ TO EJECT A DROPLET AT SPEED OF 5m/s |
|---|---|
| NG | V<16 |
| RANK A | 16≦V<18 |
| RANK B | 18≦V<20 |
| RANK C | 20≦V<23 |
| NG | 23≦V |

FIG. 1 (B)

| TEMPERATURE RANGE (℃) | DRIVE VOLTAGE (V) | | |
|---|---|---|---|
| | RANK A | RANK B | RANK C |
| 0~ 8 | 25 | 29 | 29 |
| 8~16 | 22 | 25 | 29 |
| 16~25 | 20 | 22 | 25 |
| 25~33 | 18 | 20 | 22 |
| 33~40 | 16 | 18 | 20 |
| 40~45 | 15 | 16 | 18 |
| 45~50 | 14 | 15 | 16 |

RECORDING DEVICE CAPABLE OF SETTING DRIVE VOLTAGE OF PRINT HEAD BASED ON ANALOG SIGNALS

BACKGROUND OF THE INVENTION

1. Field of the Invention

The present invention relates to a recording device having one of several ranks of print heads, the print head requiring application of a specific drive voltage depending on its rank.

2. Description of the Related Art

There has been known an ink jet recording device for printing in a plurality of colors. The ink jet recording device has an ink jet head unit having: a black head for ejecting black ink, a yellow head for ejecting yellow ink, a cyan head for ejecting cyan ink, and a magenta head for ejecting magenta ink. Each of the heads is formed with a plurality of ink chambers and nozzles, wherein the ink chambers are connected to corresponding nozzles. One piezoelectric element is provided in each ink chamber. Applying a voltage to any of the piezoelectric elements will cause the piezoelectric element to deform so that the volume of the corresponding ink chamber changes. By selectively changing the volume of ink chambers ink this manner, pressure can be applied to the ink in the ink chamber so that ink droplets are ejected from the corresponding nozzles to print images on a printing medium.

In order to ensure stable print quality, it is necessary that ink droplets are ejected from nozzles of all the heads at the same ejection speed and so as to have the same volume. However, the different heads are produced on different production lines so that variation results in different production lots. Therefore, even if the same voltage is applied to piezoelectric elements in the different heads, there will be variation in the volume in the ejected ink droplets and in the speed at which the ink droplets are ejected.

FIG. 1 (A) shows drive voltages determined as necessary, under the ejection conditions of room temperature of 25° C. for different ranked heads to eject ink droplets at a fixed speed of five meters per second in this example. Heads requiring application of less than 16 volts or of 23 or more volts are considered unsatisfactory (NG). Heads requiring application of between 16 or more volts and less than 18 volts are placed in a rank A. Heads requiring application of between 18 or more volts and less than 20 volts are placed in a rank B. Heads requiring application of between 20 or more volts and less than 23 volts are placed in a rank C. FIG. 1 (B) shows the drive voltages required to drive heads of the different ranks under nine different temperature ranges, set by dividing the temperature range of 0° C. to 50° C. is divided into nine temperature ranges.

Each head of each color is ranked in the above-described manner. Different color heads of the same rank are combined together to produce a single ink jet head unit for printing in full color. However, because the three ranks A, B, and C of ink jet head units each require application of a different strength voltage, when assembling the ink jet recording device, it is necessary to set the ink jet recording device so that it applies the drive voltage, that is, from the three different strength drive voltages, appropriate for the ink jet head unit mounted therein.

A conventional circuit for selecting the appropriate drive voltage is shown in FIGS. 2 and 3. FIG. 2 is a circuit diagram of the circuit for selecting the drive voltage. FIG. 3 is a block diagram of the control system in an ink jet recording device provided with the circuit shown in FIG. 2.

As shown in FIG. 2, in the conventional circuit for selecting drive voltage, a signal line 116 connecting a ground (0V) and a central process unit (CPU) 150 is divided into two signal lines 122, 124. A cut unit 110 is disposed on a chip mounting board (not shown in FIG. 2) and includes a cut portion 112 for cutting the signal line 122 and a cut portion 114 for cutting the signal line 124. A resistor unit 120 is disposed on the chip mounting board (not shown in FIG. 2) and includes a resistor R4 connected to the signal line 122 and a resistor R5 connected to the signal line 124. The signal lines 122 and 124 are connected to output their signals to separate predetermined ports of the CPU 150.

When assembling the driver IC chip 160 into the ink jet recording device, the cut portions 112 and 114 are cut in a manner depending on the rank of the print head, that is, depending on the required drive voltage to be set. Three possible cut patterns are possible, that is, when one or the other of the cut portions 112 and 114 are cut and when neither are cut. According to the cut pattern, one of three digital signals 01, 10, or 00 is outputted across the signal lines 122, 124 to the CPU 150. After determining the type of digital signal, the CPU 150 retrieves a drive voltage corresponding to the determined digital signal from a table stored in a RAM, for example, of the recording device.

SUMMARY OF THE INVENTION

As described above, the conventional circuit sets drive voltage by outputting a digital signal to the CPU 150 over a signal lines 122, 124. The CPU 150 then determines the type of digital signal and sets the drive voltage of the print head unit accordingly. However, with this configuration, when the number of head ranks is increased, the number of signal lines 122, 124 must also be increased. For example, three or more signal lines must be provided to set one of four or more ranks. In order to increase the number of signal lines that connect the head and the control circuit, connection processes become more complicated and production costs increase.

It is an objective of the present invention to overcome the above-described problems and to provide an ink jet recording device wherein the number of signal lines for setting a head drive voltage can be decreased between the head and the control circuit.

In order to achieve the above-described objective, a recording device according to the present invention includes: a head that performs printing on a recording medium; a drive circuit that applies, to the head, a drive voltage for driving the head; a setting signal outputting unit that outputs a drive voltage setting signal representing the drive voltage to be applied to the head by the drive circuit, the drive voltage setting signal being an analog signal; and a control portion that sets, based on the drive voltage setting signal outputted by the setting signal outputting unit, the drive voltage applied by the drive circuit for driving the head.

BRIEF DESCRIPTION OF THE DRAWINGS

The above and other objects, features and advantages of the invention will become more apparent from reading the following description of the preferred embodiment taken in connection with the accompanying drawings in which:

FIG. 1 (A) is a table showing ranking of print heads by drive voltage required at temperature of 250° C.;

FIG. 1 (B) is a table showing drive voltage required by each rank of print heads at temperatures from 0° C. to 50° C.;

FIG. 7 (B) is a side view showing the chip on board of FIG. 7 (A);

FIG. 7 (C) is a front view showing the chip on board of FIG. 7 (A);

DETAILED DESCRIPTION OF THE PREFERRED EMBODIMENTS

Figure 2:
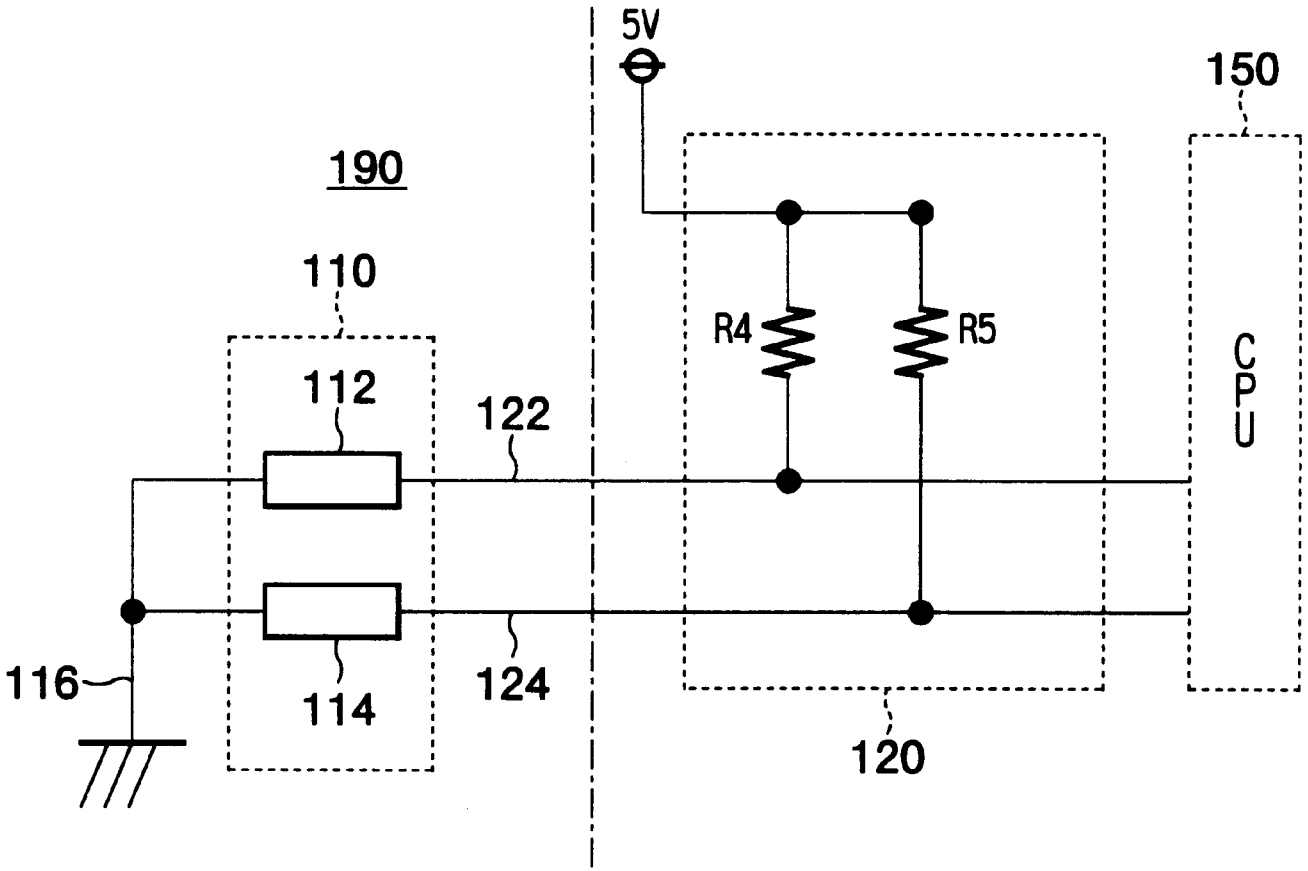
FIG. 2 is a circuit diagram showing a conventional circuit for selecting an appropriate drive voltage.
Figure 3:
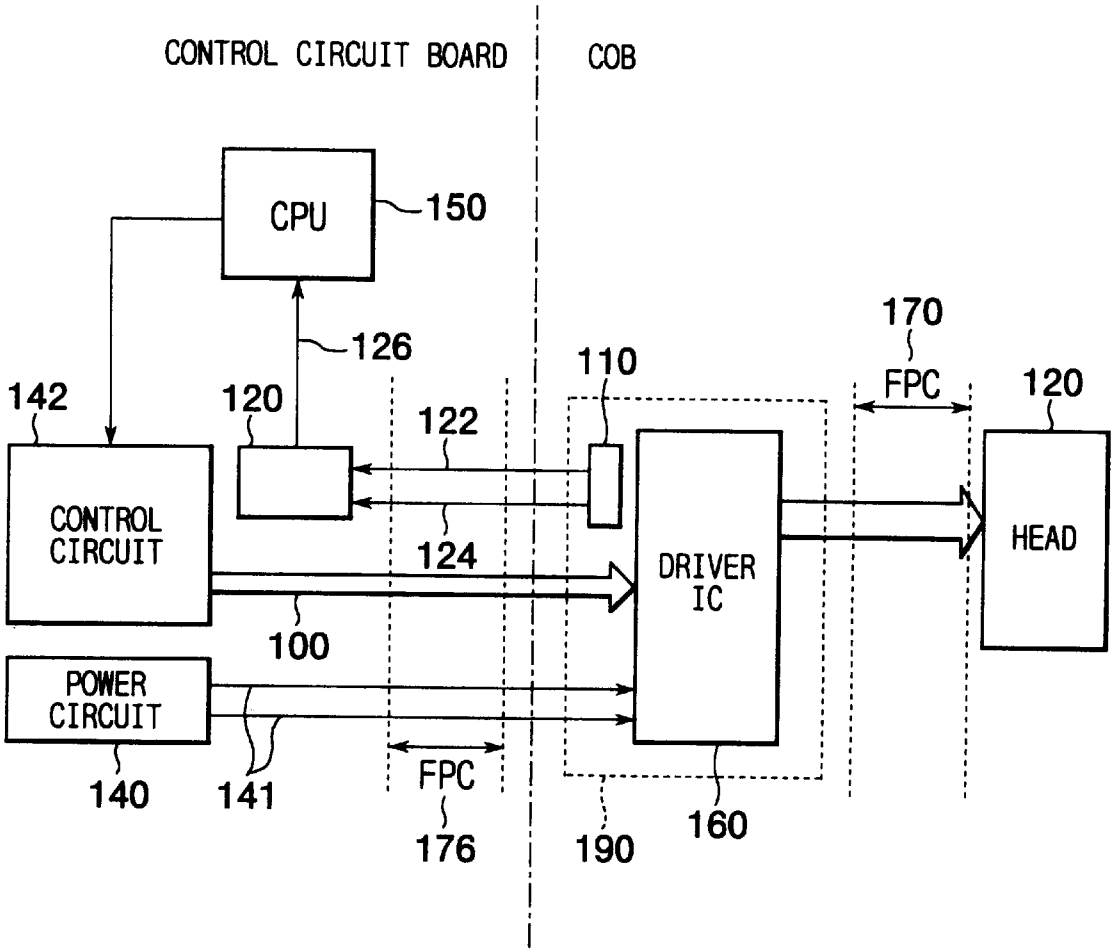
FIG. 3 is a block diagram showing a control system for the ink jet recording device provided with the circuit showing in FIG. 2.

An ink jet recording device according to a preferred embodiment of the present invention will be described while referring to the accompanying drawings wherein like parts and components are designated by the same reference numerals to avoid duplicating description.

Figure 4:
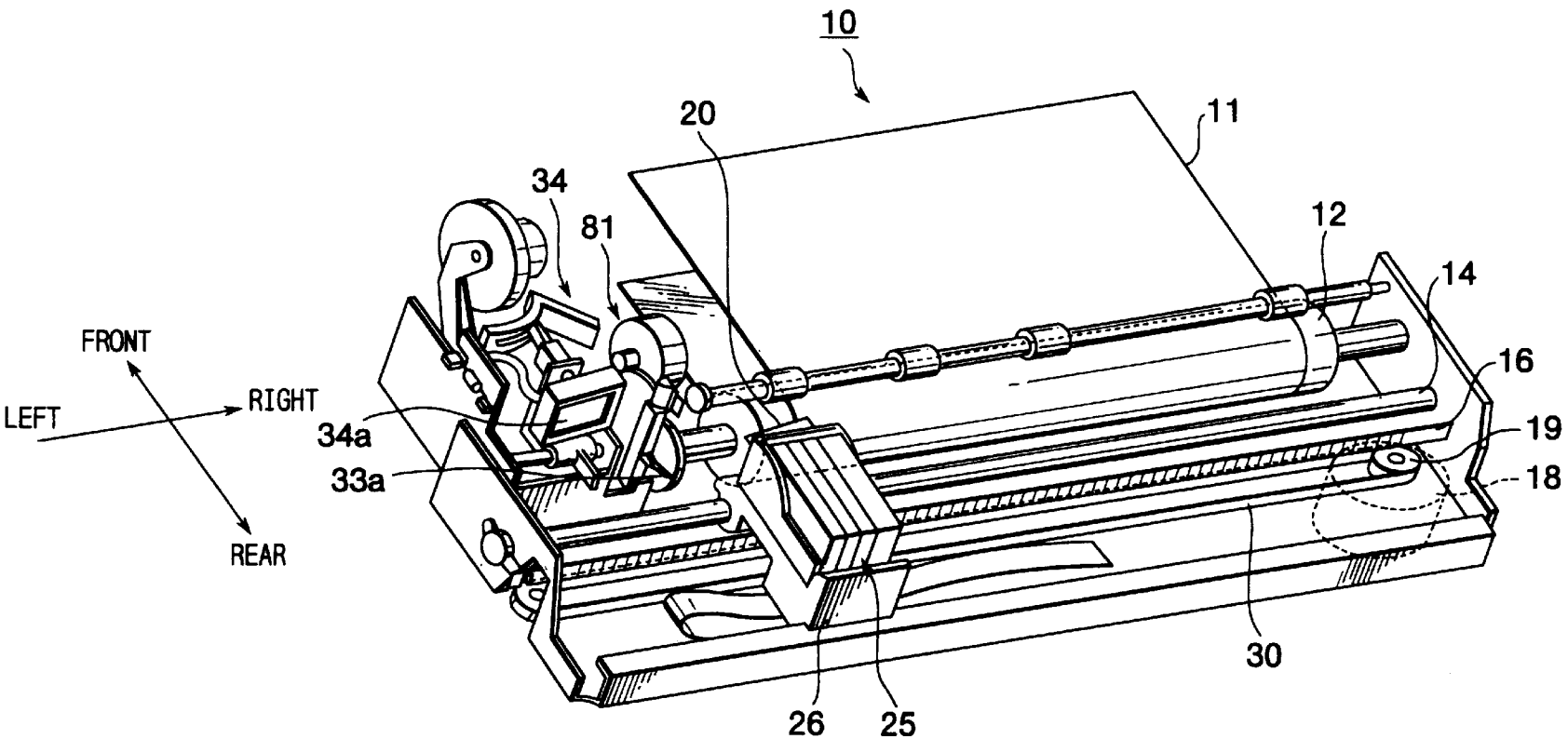
FIG. 4 is a perspective view showing a printing mechanism of a printer according to an embodiment of the present invention.
Figure 5:
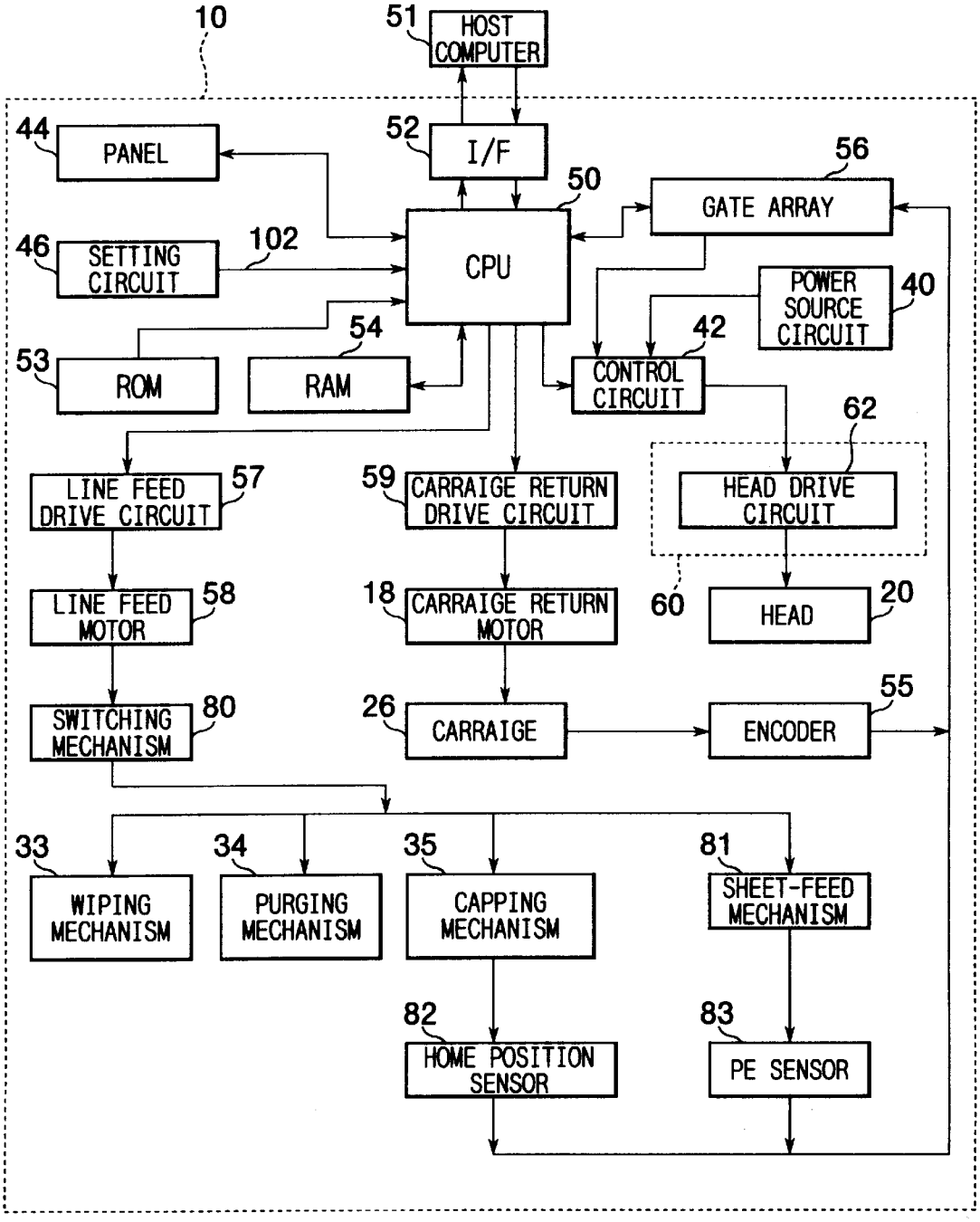
FIG. 5 is a block diagram showing connection between electrical components of the printer of the embodiment.

FIG. 4 is a perspective view showing essential components of an ink jet recording device 10 according to the embodiment. FIG. 5 is a block diagram showing a control system of the ink jet recording device 10 of FIG. 4. It should be noted that the ink jet recording device 10 of the present embodiment is a color ink jet printer for printing in full color.

As shown in FIG. 4, the printer 10 is provided with a platen 12 extending in the widthwise direction of the printer 10. The platen 12 is for supporting a print sheet 11. A guide shaft 14 is disposed adjacent to and extending in the same direction as the platen 12. A carriage 26 is mounted, at its front lower side, on the guide shaft 14 so as to be freely slidably movable along the guide shaft 14. An ink jet head unit 20 and ink cartridges 25 are mounted on the carriage 26. The ink jet head unit 20 includes print heads 21 to 24 and is disposed at a position in confrontation with the platen 12. The ink cartridges 25 are connected to corresponding heads 21 to 24 of the ink jet head unit 20 in order to supply ink to corresponding heads 21 to 24.

A carriage return (CR) motor 18 is disposed with its pulley 19 exposed at the rearward right side of the printer. An endless belt 13 connects the carriage 26 with the pulley 19 so that rotation of the pulley 19 is transmitted to drive movement of the carriage 26. With this configuration, the ink jet head unit 20 can be moved reciprocally in confrontation with the platen 12 along the guide shaft 14 by rotation of the CR motor 18.

As shown in FIG. 5, a sheet-feed mechanism 81 for rotating the platen 12 is connected to a line feed (LF) motor 58. In the present embodiment, a step motor is used for the LF motor 58 and a DC motor, whose rotational speed can be controlled by pulse width modulation (PWM) control, is used as the CR motor 18. A head power source circuit (not shown in the drawings) is provided for supplying power to drive the ink jet head unit 20, the LF motor 58, and the CR motor 18.

As shown in FIG. 4, a linear timing slit member 16 printed with slits at a predetermined interval is disposed below and in parallel with the guide shaft 14. Although not visible in FIG. 4, sensor elements are provided to the carriage 26 in confrontation with the timing slit member 16. The sensor elements pick up the interval between the slits on the timing slit member 16 and output a print signal which corresponds to the position of the carriage 26. The timing slit member 16 and the sensor elements configure an encoder 55 shown in FIG. 5.

A purging mechanism 34 is provided to the printer 10 at a position outside the printing range of the print head unit 20, that is, at a position to the left of the platen 12. A suction cap 34*a* for covering the heads 21 to 24 of the ink jet head unit 20 during purging operations is provided to the purging mechanism 34 at the leftmost side of the movement pathway of the ink jet head unit 20. In order to maintain the print heads 21 to 24 in a condition for properly ejecting ink the carriage 26 is periodically driven to the left of the platen 12 so that the purging mechanism 34 can suck foreign matter and dried ink clogging the nozzles of the print heads 21 to 24.

Although not shown in the drawings, the printer 10 is also provided with a flushing mechanism for periodically ejecting defective ink filled with air bubbles from the print heads 21 to 24 into an absorbent material. In this way, the printer 10 is provided with a flushing function for maintaining the ink jet head unit 20 in a proper printing condition.

As shown in FIG. 5, the printer 10 is also provided with a capping mechanism 35 that uses the suction cap 34*a* to cover the nozzle plates of the print heads 21 to 24 when the ink jet head unit 20 is not used for predetermined duration of time or longer. A wiping mechanism 33 is provided to the printer 10. The wiping mechanism 33 wipes off and cleans ink clinging to the nozzle plates of the ink jet heads 21 to 24. A wiping member 33*a* is provided to the right, that is, as viewed in FIG. 4, of the suction cap 34*a*. As shown in FIG. 5, a switching mechanism 80 is provided for switching drive of the LF motor 58 to selectively drive the wiping mechanism 33, the purging mechanism 34, and the capping mechanism 35.

Next, an explanation will be provided for essential components of the printer control system while referring to FIG. 5.

The printer 10 is provided with a CPU 50 for performing a variety of calculations. A variety of components are connected to the CPU 50, including: an interface 52 for receiving signals such as print data outputted from a host computer 51; a gate array 56 connected to receive input of encoder signals outputted from the encoder 55 and calculate the position of the carriage 26 accordingly; a control circuit 42 for controlling a driver IC 60 to be described later; a setting circuit 46 for setting drive voltage of the ink jet head unit 20 via the driver IC 60; a carriage drive circuit 59 for driving the carriage return motor 18; a line feed drive circuit 57 for receiving input from the CPU 50 of a line feed motor drive control signal for driving the LF motor 58; a ROM 53 and a RAM 54 for storing print programs and the like for driving the ink jet head unit 20 to perform printing operation; and a control panel 44 for inputting commands and characters and the like to be printed.

The CPU 50 stores print data received from the host computer 51 over the interface 52 in a predetermined region of the RAM 54. The CPU 50 outputs a variety of control signals for driving the LF motor 58, the CR motor 18, and the ink jet head unit 20 in accordance with the print programs prestored in the ROM 53 and the print data received from the host computer 51. While printing images on the recording medium, the CPU 50 sets a drive voltage of the ink jet head unit 20 based on drive voltage setting signals outputted from the setting circuit 46 to be described later.

The CPU 50 outputs, to the carriage drive circuit 59, a carriage drive motor control signal for driving the CR motor 18. Accordingly, the carriage drive circuit 59 outputs a carriage motor drive signal to drive the CR motor 18, which reciprocally drives the carriage 26.

The encoder 55 detects the position of the carriage 26 and outputs an encoder signal to the gate array 56 accordingly. The gate array 56 generates a variety of signals based on the inputted encoder signal. For example, the gate array 56 outputs a speed data signal indicating the speed of the carriage 26, a reference pulse, that is, a position control pulse indicating position of the carriage 26, and a print timing pulse for driving the ink jet head unit 20.

The CPU 50 receives input of the speed data, that is, time values representing distances between rising and falling edges of the encoder signal, outputted from the gate array 56 and calculates a PWM signal necessary for controlling speed of the carriage 26. The PWM signal indicates a pulse width of a drive signal for the CR motor 18. The CPU 50 receives input of the position control pulse, that is, the reference pulse from the gate array 56, and calculates the present position of the carriage 26 accordingly.

The CPU 50 also performs a variety of control operations such as writing, in a register of the gate array 56, data for enabling print start signals and delay count values for matching the print position when the direction of the carriage 26 is reversed to reverse printing direction.

The CPU 50 outputs line feed motor drive control signals to the line feed drive circuit 57, which outputs line feed motor drive signals to drive the LF motor 58 accordingly to feed the print sheet 11 in its lengthwise direction.

The CPU 50 further calculates: the number of pulses in the pulse signal, which serves as the drive signals of the LF motor 58; the amount at which the print sheet is fed by the LF motor 58 and the sheet-feed mechanism 81; and the rotational amount of cams for driving the capping mechanism 35 and purging mechanism 34. A home position sensor 82 for detecting return of the carriage 26 to the capping position, that is, the home position, is provided to the capping mechanism 35. A paper empty sensor 83 for detecting discharge or insertion of the print sheet 11 is provided to the sheet-feed mechanism 81.

Figure 6:
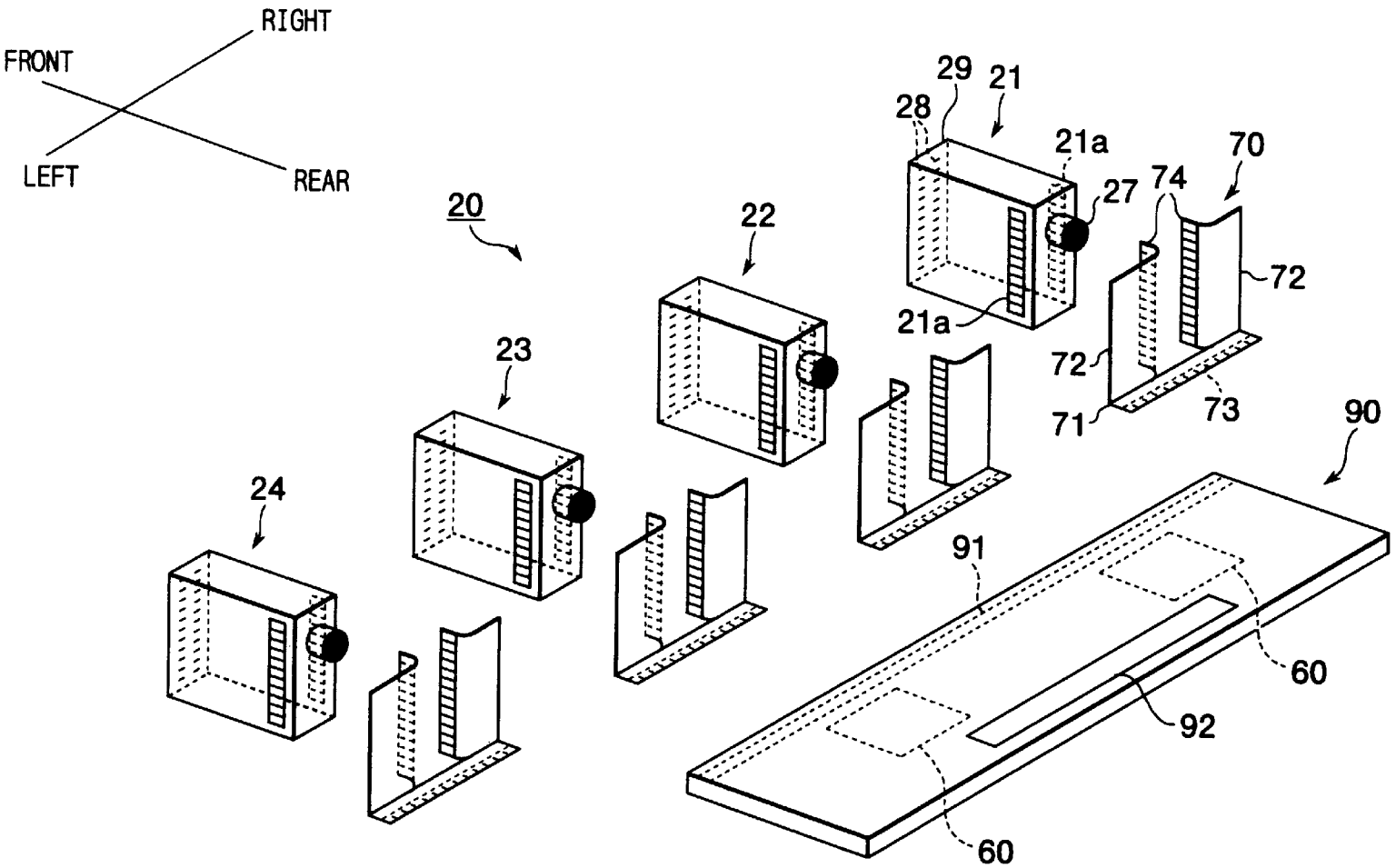
FIG. 6 is an exploded view showing an ink jet head unit according to the present embodiment.

Next, an explanation will be provided for configuration of the ink jet head unit 20 while referring to FIG. 6. FIG. 6 is an exploded view in perspective showing the ink jet head unit 20 from the rear. As can be seen in FIG. 6, the ink jet head unit 20 includes the heads 21 to 24, one flexible print circuit (FPC) 70 for each of the heads 21 to 24, and a chip on board (COB) 90.

In the present embodiment, the head 21 is for ejecting black colored ink, the head 22 is for ejecting yellow colored ink, the head 23 is for ejecting cyan colored ink, and the head 24 is for ejecting magenta colored ink. Although FIG. 6 shows the different print heads 21 to 24 separated from each other to facilitate their understanding, in actuality, the different print heads 21 to 24 are integrally formed together. Although not shown in the drawings, the ink cartridges 25 attached to the ink jet head unit 20 are actually divided into four ink cartridges, one for supplying each of the different colored inks.

Because all the heads 21 to 24 of the ink jet head unit 20 have the same configuration and are attached to the IC chip in the same manner, the following explanation will be provided by referring to the black head 21 as a representative example. For this reason, the black head 21 will be referred to simply as the head 21, hereinafter.

The head 21 has a substantially block shape. A nozzle plate 29 formed with nozzles 28 for ejecting ink droplets is provided to a vertically extending end surface, that is, to a surface facing away from the viewer in FIG. 6, of the head 21. An ink supply tube 27 for supplying ink from the ink cartridges 25 shown in FIG. 4 is provided on the end surface opposite the nozzle plate 29, that is, on the surface of the head 21 facing the viewer in FIG. 6. One of two vertically extending rows of head electrodes 21*a* is formed in vertical alignment toward the rear of each side surface of the head 21.

Next, an explanation will be provided for the flexible print circuits 70 and for configuration for attaching the ink jet head unit 20 to a driver IC chip 60 for driving the ink jet head unit 20. It should be noted that the IC chip 60 includes the head drive circuit 62 shown in FIG. 5. Because all the flexible print circuits 70 have the same configuration, only one will be referred to in the following explanation.

The flexible print circuit 70 is for electrically connecting the head 21 to a driver IC chip 60 on the chip on board 90. The flexible print circuit 70 includes: a horizontal member 71 formed in an elongated plate shape; and perpendicular portions 72, 72 each having an L shape in cross section and formed so as to extend vertically from the front edge of the horizontal member 71. A plurality of electrodes 74 for electrically connecting the FPC 70 and the head electrodes 21*a* are formed aligned in the vertical direction to mutually confronting surfaces of the perpendicular portions 72, 72. A plurality of electrodes 73 for electrically connecting the flexible print circuit 70 and the driver IC chip 60 of the chip on board 90 are formed aligned in the lengthwise direction at the upper surface of the flexible print circuit 70.

Figure 7:
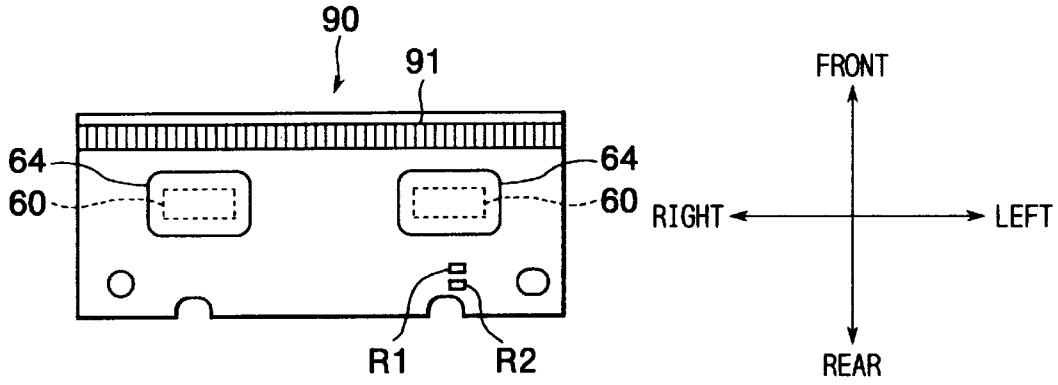
FIG. 7 (A) is a back view showing a chip on board (COB) according to the present embodiment.
Figure 7:
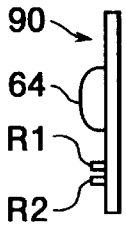
Figure 7:
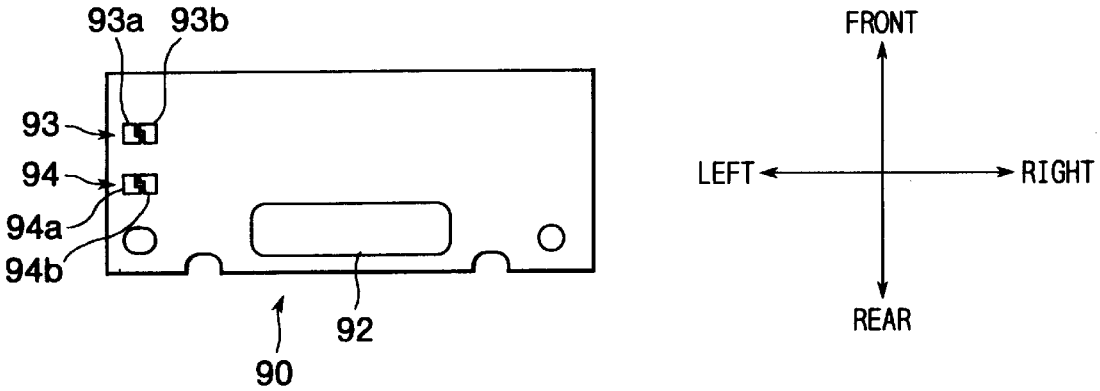

An explanation for configuration of the chip on board 90 will be provided while referring to FIG. 6 and FIGS. 7 (A) to 7 (C). FIG. 7 (A) is a schematic view showing a lower surface of the chip on board 90. FIG. 7 (B) is a side view schematically showing the chip on board 90. FIG. 7 (C) is a schematic view showing an upper surface of the chip on board 90. FIG., that is, the same surface of the chip on board 90 as is visible in FIG. 6.

As shown in FIGS. 7 (A) and 7 (B), the chip on board 90 is formed in a rectangular plate shape. A plurality of electrodes 91 for electrically connecting to the electrodes 73 of the flexible print circuit 70 are formed aligned in the lengthwise direction of the chip on board 90 on the front edge of the downward-facing surface of the chip on board 90. IC chips 60, 60 are fixed to the lower surface of the chip on board 90 and molded by potting compound 64. Two resistors R1 and R2 to be described later are disposed to the rear of the leftmost IC chip 60.

As shown in FIG. 6 and FIG. 7 (C), a plurality of electrodes 92 aligned in the lengthwise direction of the chip on board 90 are formed at the rear edge on the upper surface of the chip on board 90. The electrodes 92 are for electrically connecting the chip on board 90 with the control circuit 42 via a flexible print circuit 76 shown in FIG. 8. Two switching points 93, 94 to be described later are disposed at the right side edge on the upper surface of the chip on board 90.

Figure 8:
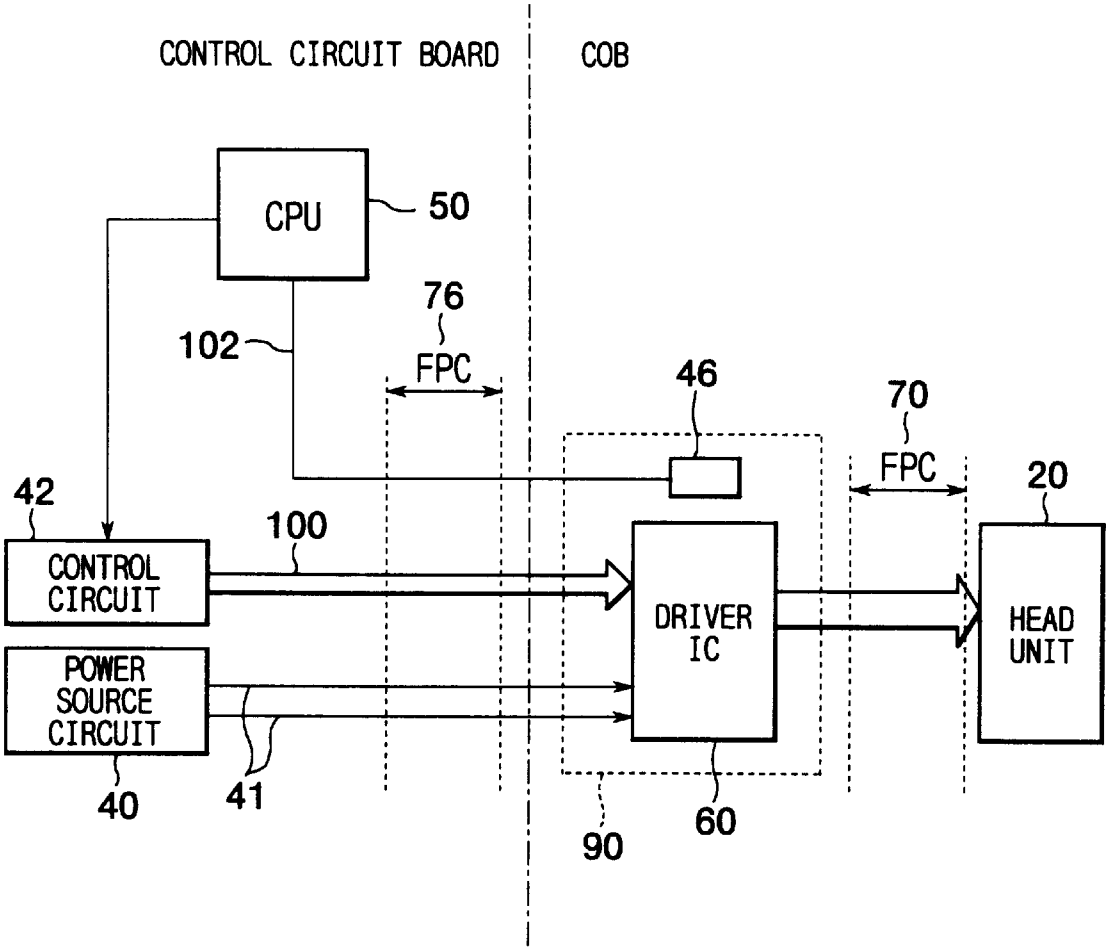
FIG. 8 is a block view schematically showing a setting circuit including the chip on board of FIG. 7 (A)
Figure 9:
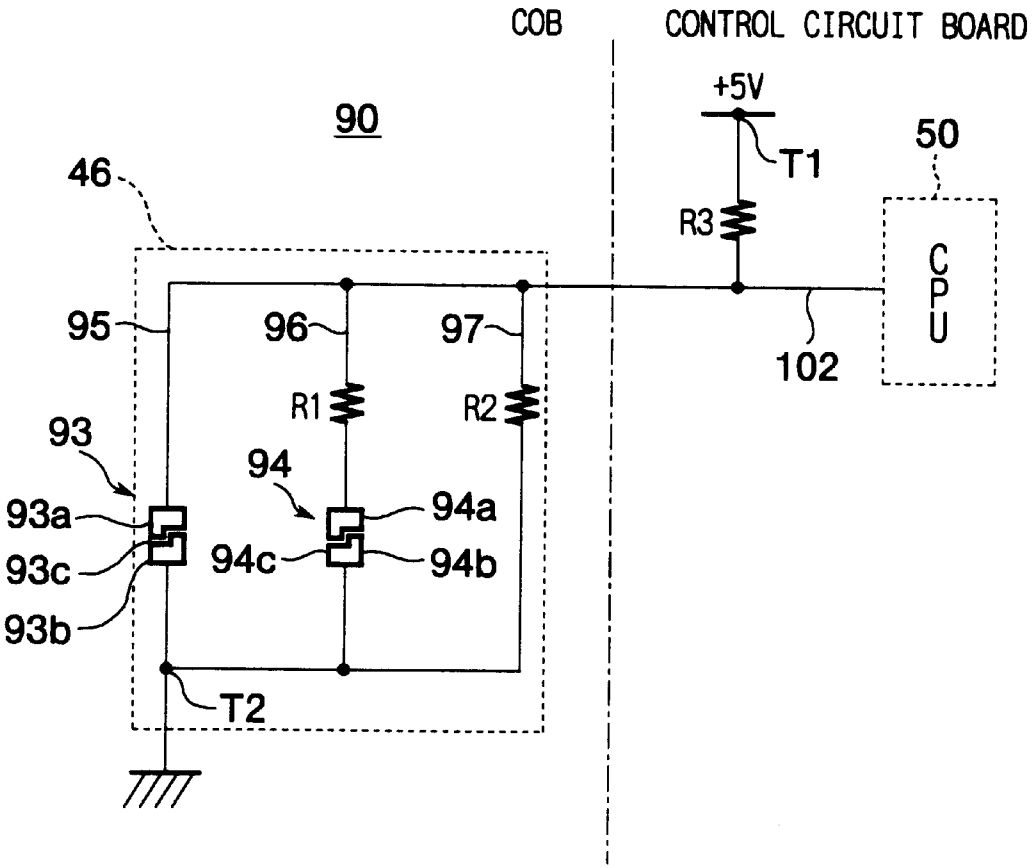
FIG. 9 is a circuit diagram showing the setting circuit of FIG. 8.

Next, while referring to FIGS. 8 and 9, an explanation will be provided for the setting circuit 46 for setting voltage to be applied to the print heads 21 to 24.

FIG. 8 is a block diagram showing location of the setting circuit 46. FIG. 9 is a circuit diagram of the setting circuit 46. The setting circuit 46 is provided on the chip on board 90. A single signal line 102 for outputting a drive voltage setting signal electrically connects the setting circuit 46 with an input port of the CPU 50 on the control circuit board side. The IC chip 60 is connected to the control circuit 42 by a signal line 100. The IC chip 60 is connected to a power source 40 via a power source line 41. The head drive circuit 62 within the IC chip 60 outputs a drive signal to the ink jet head unit 20 based on a control signal outputted over the signal line 100.

Next, an explanation will be provided for the circuit configuration of the setting circuit 46 while referring to FIG. 9.

As shown in FIG. 9, within the chip on board 90, three signal lines 95, 96, and 97 are connected in parallel to the signal line 102. The resister R1 is disposed along the signal line 96 and the resister R2 is disposed along the signal line 97. The switching point 93, which is for switching the signal line 95 between a continuous and non-continuous state, is provided along the signal line 95. The switching point 94, which is for switching the signal line 96 between a continuous and non-continuous state, is provided along the signal line 96 between the resistor R1 and ground.

The switching point 93 includes conductive portions 93*a* and 93*b*, each formed from a continuous metal films. The conductive portions 93*a*, 93*b* are separated by a space 93*c*. In the same way, the switching point 94 includes conductive portions 94*a* and 94*b*, each formed from continuous metal film. The conductive portions 94*a*, 94*b* are separated by a space 94*c*.

The spaces 93*c*, 94*c* serve as non-continuous portions. The sets of conduction portions 93*a* and 93*b*, 94*a* and 94*b* can be selectively brought into electrical connection by applying solder or other conductive material to the spaces 93*c*, 94*c*, respectively.

In the present embodiment, the resister R1 and resister R2 are formed from chip resisters and, as shown in FIG. 7 (B), are provided so as to protrude from the rear surface of the chip on board 90. As shown in FIG. 7 (C), the switching points 93 and 94 are formed on the upper surface of the chip on board 90 so that solder can be easily applied to the non-conducting portions, that is, to the spaces 93*c*, 94*c*, when connecting the ink jet head unit 20 to the chip on board 90.

Figure 10:
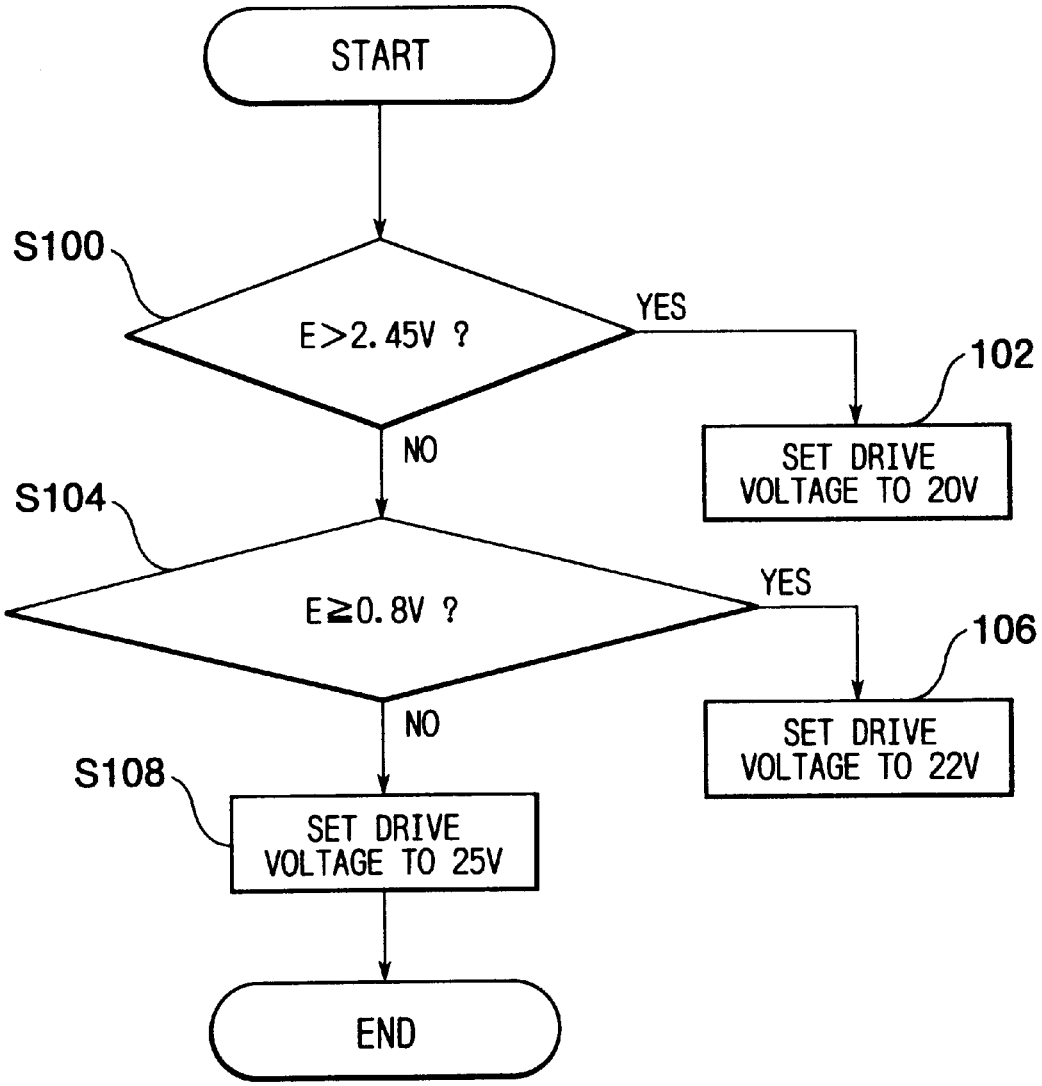
FIG. 10 is a flowchart representing a routine for setting drive voltage of the print head unit of FIG. 6.

Next, while referring to FIGS. 9 and 10, an explanation will be provided for processes performed by the CPU 50 based on an analog signal outputted by the setting circuit 46 to set a drive voltage of the print head unit 20. FIG. 10 is a flowchart showing processes performed by the CPU 50 for setting the drive voltage. It will be assumed that, as shown in FIG. 9, a five volt direct voltage is applied between a terminal T1 and a terminal T2. Also, the resister R1 has a resistance of 1.5 K Ω, the resister R2 has a resistance of 4.3 K Ω, and a resister R3 has a resistance of 2.2 K Ω. In this example, ink jet heads requiring a drive voltage of 20 V are grouped in rank A, ink jet heads requiring a drive voltage of 22 V are grouped in rank B, and ink jet heads requiring a drive voltage of 25 V are grouped in rank C. The RAM 54 stores a table indicating correspondence between drive voltages and a voltage E of a drive voltage setting signal outputted from the setting circuit 46 and detected by the CPU 50.

First in S100, whether or not the drive voltage setting signal outputted from the setting circuit 46 over the signal line 102 has a voltage E of greater than 2.45V is determined. When the ink jet head unit 20 is a rank A ink jet head unit 20, then both the switching points 93 and 94 are maintained in a non-continuous state, that is, no solder is applied to the spaces 93*c*, 94*c*. In this case, the drive voltage setting signal outputted over the signal line 102 will have a voltage E of 3.3V, which is greater than 2.45V. Therefore, S100 will result in a positive determination so that in S102 the CPU 50 sets the drive voltage to 20V.

When the drive voltage setting signal has a voltage E less than or equal to 2.45V (S100:NO), then, in S104, whether or not the voltage E of the drive voltage setting signal greater than or equal to 0.8V is determined. When the ink jet head unit 20 is a rank B ink jet head, then the signal line 96 is brought into a continuous condition by application of solder to the space 94*c* of the switching point 94. The switching point 93 is maintained in a non-continuous state. As a result, the drive voltage setting signal outputted over the signal line 102 will have a voltage E of 1.6V, which is less than 2.45V but greater than 0.8V, so that S104 results in positive determination. As a result, in S106, the CPU 50 sets the drive voltage to 22V.

When the voltage E of the drive voltage setting signal is less than or equal to 0.8V (S104:NO), then, in S108, the CPU 50 sets the drive voltage to 25V. When the ink jet head unit 20 is a rank C ink jet head, then the signal line 95 is brought into a continuous condition by application of solder to the space 93*c* of the switching point 93. The switching point 94 is kept in a non-continuous state. As a result, the drive voltage setting signal outputted over the signal line 102 will have a voltage E of 0V. Therefore, in S108 the CPU 50 sets the drive voltage to 25V.

Said differently, the drive voltage setting signal outputted over the signal line 102 is an analog signal with a voltage E of 0V, 1.6V, or 3.3V. This contrasts with the conventional circuit shown in FIG. 2, wherein the signals outputted over signal lines 122 and 124 are digital signals, that is, with a voltage of either 0V or another predetermined voltage value.

It should be noted that the voltages used in S1OO and S104 as reference values to compare with the voltage E of the drive voltage setting signal, which is outputted over the signal line 102, are set to take variation in resistance values of the resisters R1 to R3 into account. Also, the CPU 50 determines which voltages to set in S102, S106, and S108 by comparing the voltage V of the drive voltage setting signal with possible drive voltages stored in the table form in the RAM 54 and then determining a corresponding drive voltage appropriate for the voltage E.

With the above-described configuration, depending on whether or not the switching points 93, 94 are in continuous states, the voltage E of the drive voltage setting signal outputted over the signal line 102 can be changed between three different voltage values. Therefore, the CPU 50 can set three different drive voltages based on the voltage E of the drive voltage setting signal. In other words, by setting a voltage value for each of the ranks into which heads are categorized, the drive voltage setting signal can be an analog signal so that only a single signal line 102 is required. Therefore, even if the number of head ranks is increased, there is no need to increase the number of signal lines connecting the chip on board 90 to the control circuit board. Accordingly, operations for connecting the head to the control circuit board and also costs of production can be reduced.

While the invention has been described in detail with reference to specific embodiments thereof, it would be apparent to those skilled in the art that various changes and modifications may be made therein without departing from the spirit of the invention, the scope of which is defined by the attached claims.

For example, in the present embodiment, the ink jet recording device is divided into three different ranks and drive voltage was selected from one of three voltages for the three ranks. However, drive voltage can be selected from one of four or more types of drive voltages. In this case, the number of resisters connected in parallel on the signal line 102 and the number of switching points can be increased accordingly. Although the present embodiment describes that the present invention applied to a color ink jet printer, the present invention could be applied equal success to other types of recording devices, such as monochrome ink jet printers and thermal printers.

The setting circuit 46 and the signal line 102 output an analog drive voltage setting signal from the head to the control circuit. The CPU 50 in S100 to S108 sets the drive voltage for driving the ink jet print head based on the analog drive voltage setting signal. Because the drive voltage setting signal for setting drive voltage of the ink jet head is analog signal, drive voltage can be set based on analog drive voltage setting signal. Accordingly, even if the number of predetermined drive voltages is increased, types of the drive voltages can be indicated by merely changing the analog values indicated by the voltage of the setting signal. Therefore, there is no need to increase the signal system for outputting a drive voltage setting signal from the head portion to the control circuit. As a result, processes for connecting the head to the control circuit board and production costs can be decreased.

A plurality of signals with different voltages can be produced according to combinations of continuity and non-continuity of resisters disposed on the signal line connecting the head to the control portion. The drive voltage can be set based on the resultant signal. As a result, even if the number of types of drive voltage setting signals is increase, this can be handled by increasing the number of combinations of resisters continuous and discontinuous with the signal line. Therefore, unnecessary increase in the number of signal lines is prevented.

Of the plurality of resisters, by electrically connecting a non-continuous portion formed between a particular resister and ground of the signal line using a conductive material, the predetermined resister and ground of the signal line can be brought into continuity with each other, or the predetermined resister and signal line can be left in a non-continuous condition by not electrically connecting them with the conductive material. As a result, the signal outputted over the signal line can be provided with selected one of the plurality of voltage values. For example, non-continuous portions can be electrically connected by solder so that the predetermined resister and signal line are brought into continuity with each other.

Because a non-continuous portion is provided on a circuit board having a drive circuit, the non-continuous portion can be electrically connected using conductive material during assembly of the circuit board.

Because only a single signal line is used, a number of different drive voltages can be set using only a minimal number of signal lines.

What is claimed is:

1. A recording device comprising:

a head that performs printing on a recording medium;

a drive circuit that applies, to the head, a drive voltage for driving the head;

a setting signal outputting unit that outputs a drive voltage setting signal representing the drive voltage applied to the head by the drive circuit, the drive voltage setting signal being an analog signal;

a control portion connected to the setting signal outputting unit by a single signal line for comparing the drive voltage setting signal outputted by the setting signal outputting unit, with reference values to determine and set the drive voltage applied by the drive circuit for driving the head;

the setting signal outputting unit including a plurality of resistors selectively connectable to the signal line by selecting the continuity or non-continuity of each resistor for developing a voltage on the signal line, thereby providing the drive voltage setting signal according to the continuity of the resistors;

the drive voltage for driving the head selected from a plurality of stored drive voltages, according to an analog voltage value of the drive voltage setting signal that develops on the single signal line according to the continuity of the resistors.

2. A recording device as claimed in claim 1, wherein a non-continuous portion is formed between a ground and a predetermined resistor of the plurality of resistors, the non-continuous portion being provided on a substrate that includes the drive circuit.

3. A recording device comprising:

a head that performs printing on a recording medium;

a drive circuit that applies, to the head, a drive voltage for driving the head;

a setting signal outputting unit that outputs a drive voltage setting signal representing the drive voltage applied to the head by the drive circuit, the drive voltage setting signal being an analog signal; and a control portion responsive to the drive voltage setting signal outputted by the setting signal outputting unit, for setting the drive voltage applied by the drive circuit for driving the head;

wherein the setting signal outputting unit includes a single signal line connecting the setting signal outputting unit and the control portion; and a plurality of resistors selectively connectable to the signal line by selecting the continuity on non-continuity of each resistor to develop a voltage on the signal line, thereby providing the drive voltage setting signal depending on a selected at least one of the plurality of resistors selected for connection to the signal line in accordance with its conductivity or non-conductivity; and wherein the control portion stores possible voltages of the drive voltage setting signal in correspondence with appropriate drive voltages applied to the head by the drive circuit, the control portion determining the drive voltage applied by the drive circuit for driving the head by determining the voltage developed on the signal line, comparing the voltage with the possible voltages stored in the control portion, and determining a corresponding one of the appropriate drive voltages stored in the control portion.

4. A recording device as claimed in claim 2, wherein the plurality of resistors include two resistors connected in parallel, the non-continuous portion being formed between one of the two resistors and ground.

5. A recording device as claimed in claim 2, further comprising a print head unit including the head, the drive circuit, and a plate member for supporting the drive circuit, the non-continuous portion being formed on the plate member at an easily accessible position.

6. A recording device as claimed in claim 1, wherein the plurality of resistors includes two resistors connected in parallel, one having the non-continuous portion formed between a terminal thereof and ground.

7. A recording device as claimed in claim 1, further comprising a print head unit including the head, the drive circuit, and a plate member for supporting the drive circuit, a non-continuous portion being formed on the plate member at an accessible position.

8. A recording device as claimed in claim 1, wherein the control portion outputs a control signal to the drive circuit to drive the head in order to print images on a print medium.

9. A recording device as claimed in claim 1, wherein the print head is an ink jet print head that prints by selectively ejecting ink droplets from a nozzle.

10. A recording device as claimed in claim 1, wherein the control portion is connected at its output to an input of the drive circuit and generates a control signal at the input of the drive circuit that corresponds to the driving voltage.

11. A recording device as claimed in claim 1, wherein the control includes a central processing unit.

12. A recording device comprising:

a printing head;

a drive circuit for applying a preselected driving voltage to the head;

a setting signal generating circuit for outputting an analog setting voltage along a single signal line, the setting voltage related to the driving voltage; and a controller connected to the setting signal outputting unit by the single signal line and responsive to the setting voltage, and connected at an output thereof to the drive circuit for generating a control signal at the input of the drive circuit that corresponds to the driving voltage;

the setting signal generating circuit including a plurality of resistors selectively connectable to the signal line by selecting the continuity or non-continuity of each resistor for developing a voltage on the signal line, thereby providing the setting voltage according to the continuity of the resistors;

the controller including a storage device that stores a set of setting voltages and corresponding control signals to be input to the drive circuit for producing a corresponding drive voltage that is applied to the head by the drive circuit; and a comparator that compares an instant setting voltage with the stored set of setting voltages and determines a corresponding control signal to be input to the drive circuit.

13. The apparatus in claim 12 wherein least one of the resistor is connectable to a bias voltage;

and a connecting element connecting the at least one resistor to the signal line.

14. The apparatus set forth in claim 13 wherein the setting signal generating circuit further comprises:

open circuit portions connected to each of the plurality of resistors, the open circuit portions being selectively closed for connection to the bias voltage.

15. The apparatus set forth in claim 14 further comprising a substrate for mounting the open circuit portions and the drive circuit.

16. The apparatus set forth in claim 14 further comprising:

a plate for supporting the head and drive circuit;

and further wherein the open circuit portions are located on an accessible surface of the plate.

17. The apparatus set forth in claim 12 wherein the head is driven by the drive circuit to print images on a print medium.

18. The apparatus set forth in claim 12 wherein the head is an ink jet print head.

19. The apparats set forth in claim 13 wherein the plurality of resistors include at least two resistors connected in parallel.

20. A method of driving a printing head with a preselected driving voltage comprising the steps:

storing data relating a plurality of driving voltages to corresponding setting voltages;

selectively altering a resistive network to produce an analog setting voltage related to the preselected driving voltage, the altering affecting the continuity or non-continuity of each resistor in the resistive network for developing a voltage on a single signal line, thereby providing the setting voltage according to the continuity of the resistors;

outputting the setting voltage along the single signal line;

comparing the setting voltage, appearing on the single signal line, to those stored, and selecting a control signal corresponding to the setting voltage and a related driving voltage;

outputting the control signal to a driver;

driving the head from the driver with a drive voltage corresponding to the control signal.

21. The method set forth in claim 20 further comprising the step of ink jet printing an image on a print medium in response to driving the head.

22. The device of claim 1 wherein the control portion includes a storage device that stores the reference values.

23. A recording device as claimed in claim 6, wherein the non-continuous portion is provided on a substrate provided with the drive circuit.

* * * * *